US009267499B2

(12) United States Patent
Chu

(10) Patent No.: US 9,267,499 B2
(45) Date of Patent: Feb. 23, 2016

(54) AIR PUMP

(75) Inventor: Keng-Fong Chu, New Taipei (TW)

(73) Assignee: JIAO HSIUNG INDUSTRY CORP., New Taipei (TW)

( * ) Notice: Subject to any disclaimer, the term of this patent is extended or adjusted under 35 U.S.C. 154(b) by 341 days.

(21) Appl. No.: 13/611,367

(22) Filed: Sep. 12, 2012

(65) Prior Publication Data

US 2013/0189136 A1 Jul. 25, 2013

(30) Foreign Application Priority Data

Jan. 20, 2012 (TW) ..... 101201617 U

(51) Int. Cl.
*F04B 9/14* (2006.01)
*F04B 33/00* (2006.01)

(52) U.S. Cl.
CPC ..... *F04B 33/005* (2013.01)

(58) Field of Classification Search
CPC ..... F04B 33/055
USPC ..... 417/437, 555.1; 92/165 R, 169.1
See application file for complete search history.

(56) References Cited

U.S. PATENT DOCUMENTS

| | | | | | |
|---|---|---|---|---|---|
| 1,263,201 | A | * | 4/1918 | Brown | 417/547 |
| 2,386,562 | A | * | 10/1945 | Mahoney | 285/242 |
| 2,455,946 | A | * | 12/1948 | Peters et al. | 74/503 |
| 4,106,392 | A | * | 8/1978 | Johnson et al. | 92/128 |
| 4,569,275 | A | * | 2/1986 | Brunet | F04B 33/005 417/555.1 |
| 5,316,350 | A | * | 5/1994 | Kollenbrandt et al. | 285/242 |
| 5,476,372 | A | * | 12/1995 | Yang | 417/553 |
| 6,017,196 | A | * | 1/2000 | Wu | 417/234 |
| 6,017,201 | A | * | 1/2000 | Yang | 417/454 |

* cited by examiner

*Primary Examiner* — Justin Jonaitis
*Assistant Examiner* — Stephen Mick
(74) *Attorney, Agent, or Firm* — patenttm.us

(57) ABSTRACT

An air pump has a body, a piston rod and a seat cap assembly. The body has an outer protrusion and a first engaging part. The outer protrusion protrudes from the body. The first engaging part is longitudinally mounted on the outer protrusion. The piston rod is inserted into the body. The seal cap assembly has a top cover and a sleeve. The top cover is movably mounted on the piston rod. The sleeve is mounted on the body and has a retaining rib and a second engaging part. The retaining rib protrudes from an inner surface of the sleeve and abuts against a retaining surface of the outer protrusion. The second engaging part is longitudinally mounted on the inner surface of the sleeve and is engaged with the first engaging part of the body. Therefore, the relative rotation between the body and the sleeve is prevented.

13 Claims, 11 Drawing Sheets

AIR PUMP

CROSS-REFERENCE TO RELATED APPLICATIONS

This application claims the benefit of the Taiwan patent application No. 101201617, filed on Jan. 20, 2012, the disclosure of which is incorporated herein in its entirety by reference.

BACKGROUND OF THE INVENTION

1. Field of the Invention

The invention relates to an air pump, and more particularly to an air pump which decreases manufacturing elements and is easy in assembling.

2. Description of Related Art

With reference to FIGS. 8 and 9, an air pump comprises a body 60, a piston rod 70 and a seal cap assembly 80. The body 60 is hollow and has a top surface, a bottom surface, an outer surface, an inner surface, an opening 61, a nozzle 62 and multiple concave loops 63. The opening is formed in the top surface of the body 60. The nozzle 62 is mounted on the bottom surface of the body 60. The concave loops 63 are formed in the inner surface of the body 60 near the opening 61 of the body 60.

The piston rod 70 is inserted into the body 60 and has a piston 71. The piston 71 is mounted on an end of the piston rod 70 and is located in the body 60.

The seal cap assembly 80 has a plug 81 and a collar 82. The plug 81 is movably mounted on the piston rod 70 and has multiple convex ribs 83. The convex ribs 83 are respectively received in the concave loops 63 of the body 60. When the piston rod 70 is pressed into the body 60 via the opening 61, each convex rib 83 is engaged with one of the concave loops 63. The collar 82 is mounted on the body 60 and outside the outer surface of the body 60 near the opening 61 of the body 60. The collar 82 has a flange 84. The flange 84 protrudes inward from the collar 82 and is mounted between the top surface of the body 60 and the plug 81.

After the plug 81 is fixedly engaged in the opening 61 of the body 60, a gap is formed between the plug 81 and the top surface of the body 60. Thus, the air pump needs the collar 82 to close the gap. The flange 84 of the collar 82 is just mounted between the top surface of the body 60 and the plug 81 and is not fixed, so this may cause the relative rotation between the collar 82 and the body 60. The relative rotation between the collar 82 and the body 60 may be considered as a defect of the air pump in that the plug 81 that is not sealed tightly. Then, the stores selling the air pump have the problems of having to refund customers and suffer damage to the reputation as a supplier of goods.

To overcome the shortcomings, the present invention provides an air pump obviate the aforementioned problems.

SUMMARY OF THE INVENTION

An objective of the invention is to provide an air pump to prevent a relative rotation between a collar and a body.

The air pump comprises a body, a piston rod and a seal cap assembly. The body is hollow and has a top end, a bottom end, an opening, a nozzle, an outer protrusion and a first engaging part. The bottom end is opposite to the top end of the body. The opening is formed in the top end of the body. The nozzle is mounted on the bottom end of the body. The outer protrusion is radially formed on and protrudes from the outer surface of the body at the top end of the body, and has an outer surface, a bottom surface and a retaining surface. The retaining surface is formed on the bottom surface of the outer protrusion. The first engaging part is longitudinally mounted on the outer surface of the outer protrusion. The piston rod is inserted into the body and has a piston. The piston is mounted on an end of the piston rod and is located in the body. The seal cap assembly has a top cover and a sleeve. The top cover is movably mounted on the piston rod. The sleeve is mounted on the top end of the body and has an inner surface, a retaining rib and a second engaging part. The retaining rib radially protrudes from the inner surface of the sleeve and abuts against the retaining surface of the outer protrusion. The second engaging part is longitudinally mounted on the inner surface of the sleeve and is engaged the first engaging part of the body.

With the engagement between the first engaging part of the body and the second engaging part of the sleeve, the relative rotation between the body and the seal cap assembly is prevented. Therefore, the seal cap assembly is steadily fixed on the body. Thus, the air pump is a reliable and efficient device which satisfies purchasers.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
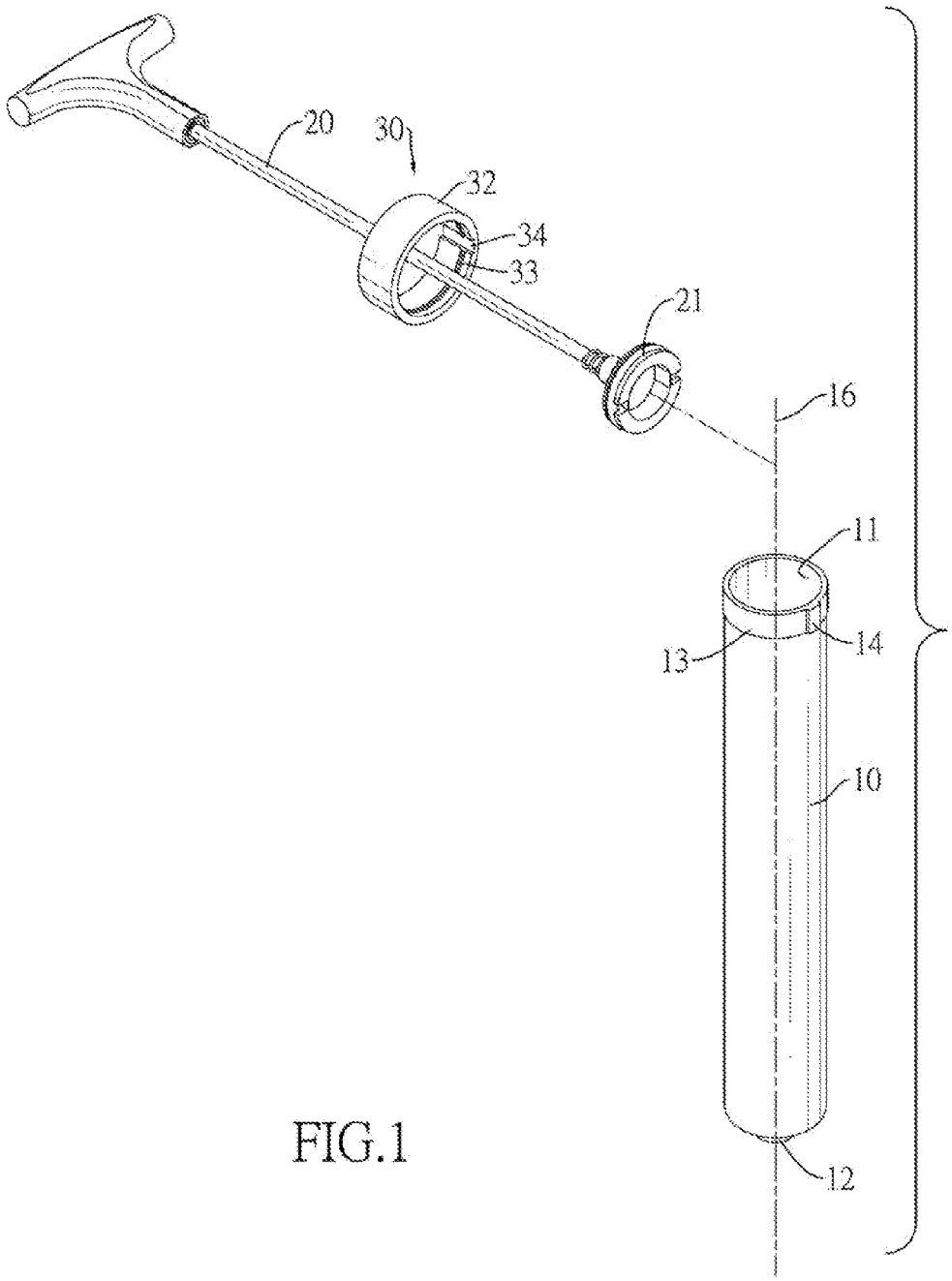
FIG. 1 is an exploded perspective view of a first embodiment of an air pump in accordance with the present invention.

With reference to FIG. 1, an air pump in accordance with the present invention comprises a body 10, a piston rod 20 and a seal cap assembly 30.

Figure 2A:
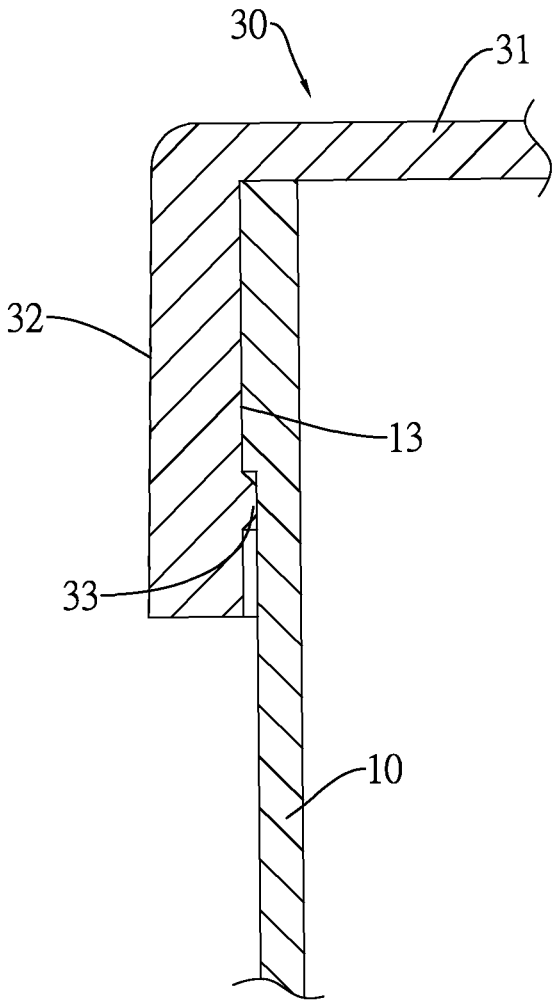
FIG. 2A is an enlarged cross sectional side view of the air pump in FIG. 1.
Figure 2B:
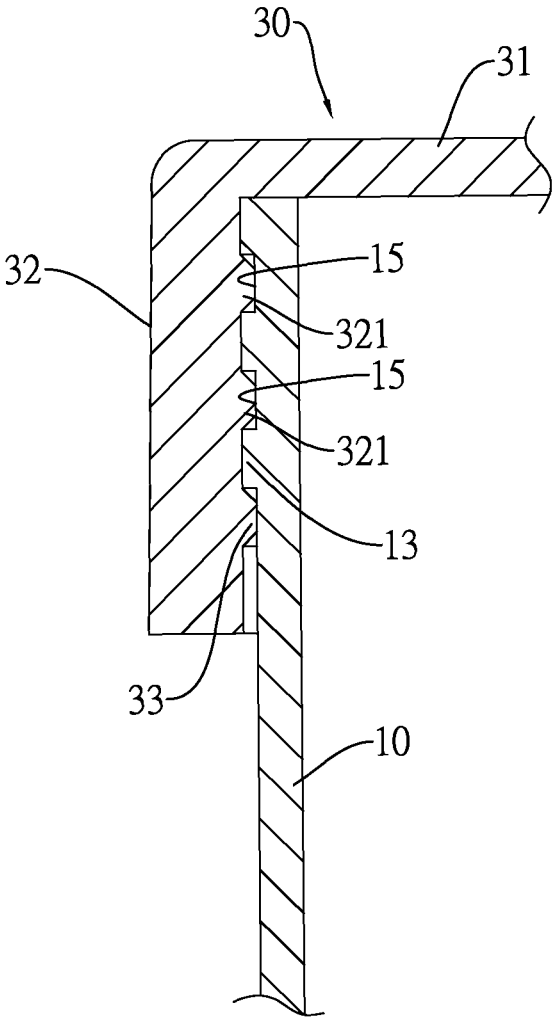
FIG. 2B is an enlarged cross sectional side view of a second embodiment of an air pump in accordance with the present invention.
Figure 3A:
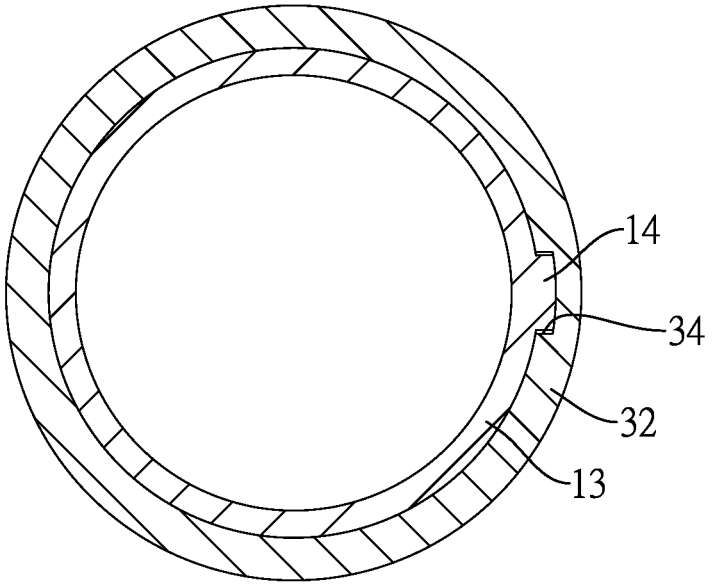
FIG. 3A is cross sectional top view of the air pump in FIG. 1.

The body 10 is hollow. The body 10 has an axis 16, a top end, a bottom end, an opening 11, a nozzle 12, an outer protrusion 13 and a first engaging part 14. The axis 16 is defined axially through the body 10. The bottom end is opposite to the top end of the body 10. The opening 11 is formed in the top end of the body 10. The nozzle 12 is mounted on the bottom end of the body 10. The outer protrusion 13 is radially formed on and protrudes from the outer surface of the body 10 at the top end of the body 10, and has an outer surface, a bottom surface and a retaining surface. The retaining surface is formed on the bottom surface of the outer protrusion 13. The first engaging part 14 is longitudinally mounted on the outer surface of the outer protrusion 13 and is parallel to the axis 16 of the body 10. With reference to FIGS. 1 and 3A, the first engaging part 14 has a first radial section. The first radial section of the first engaging part 14 is formed on and protrudes radially from the outer surface of the outer protrusion 13, is perpendicular to the axis 16 of the body 10, is in a rectangular shape, and has two rotating-proof surfaces. The two rotating-proof surfaces are respectively formed on two opposite sides of the first engaging part 14. Each one of the rotating-proof surfaces is connected to and perpendicular to the outer surface of the outer protrusion 13. Furthermore, the first engaging part 14 may be a key. With reference to FIG. 2B showing a second embodiment, the body 10 has multiple securing grooves 15. The securing grooves 15 are formed in the outer surface of the outer protrusion 13.

The piston rod 20 is inserted into the body and has a piston 21. The piston 21 is mounted on an end of the piston rod 20 and is located in the body 10.

The seal cap assembly 30 has a top cover 31 and a sleeve 32. The piston rod 20 slidably and reciprocally extends through the cover 31. The sleeve 32 is mounted on the top end of the body 10 and has an inner surface, a retaining rib 33, and a second engaging part 34. The retaining rib 33 radially protrudes from the inner surface of the sleeve 32. With reference to FIG. 2A, the retaining rib 33 abuts against the retaining surface of the outer protrusion 13. The second engaging part 34 is longitudinally formed on the inner surface of the sleeve 32, extends upwardly from a bottom end of the sleeve 32 to the top cover 31, is parallel to the axis 16 of the body 10, and is engaged with the first engaging part 14 of the body 10. Furthermore, the sleeve 32 of the seal cap assembly 30 may be integrally formed with the top cover 31 of the seal cap assembly 30. With reference to FIG. 2B, the sleeve 32 has multiple securing ribs 321 formed on and protruding from the inner surface of the sleeve 32, and each securing rib 321 of the sleeve 32 is engaged with a respective one of the securing grooves 15 of the body 10.

Figure 3B:
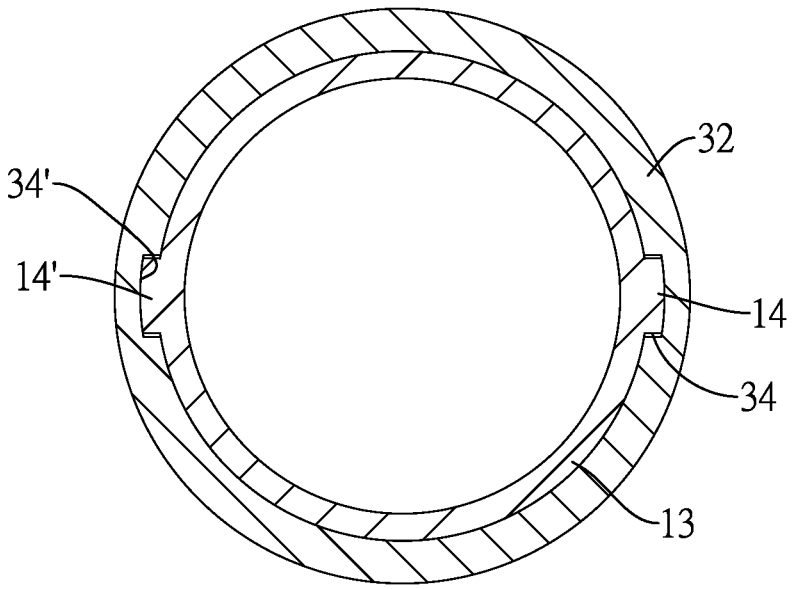
FIG. 3B is cross sectional top view of a third embodiment of an air pump in accordance with the present invention.

With reference to FIG. 3A, the second engaging part 34 of the seal cap assembly 30 is a keyway, and the first engaging part 14 of the body 10 is a key. Thus, the key is fixedly inserted into the keyway. With reference to FIG. 3B, the body 10 further has a third engaging part 14'. The third engaging part 14' is longitudinally mounted on the outer surface of the outer protrusion 13 of the body 10 and is parallel to the axis 16 of the body 10. With reference to FIGS. 1 and 3B, the third engaging part 14' has a second radial section. The second radial section of the third engaging part 14' is formed on and protrudes radially from the outer surface of the outer protrusion 13, is perpendicular to the axis 16 of the body 10, and has a rectangular shape. The seal cap assembly 30 further has a fourth engaging part 34'. The fourth engaging part 34' is longitudinally mounted on the inner surface of the sleeve 32 and is parallel to the axis 16 of the body 10 and correspond to the location and shape of the third engaging part 14'. The third engaging part 14' of the outer protrusion 13 of the body 10 is engaged with the fourth engaging part 34' of the sleeve 32 of the seal cap assembly 30 to increase the security of the combination between the body 10 and the seal cap assembly 30.

Figure 6:
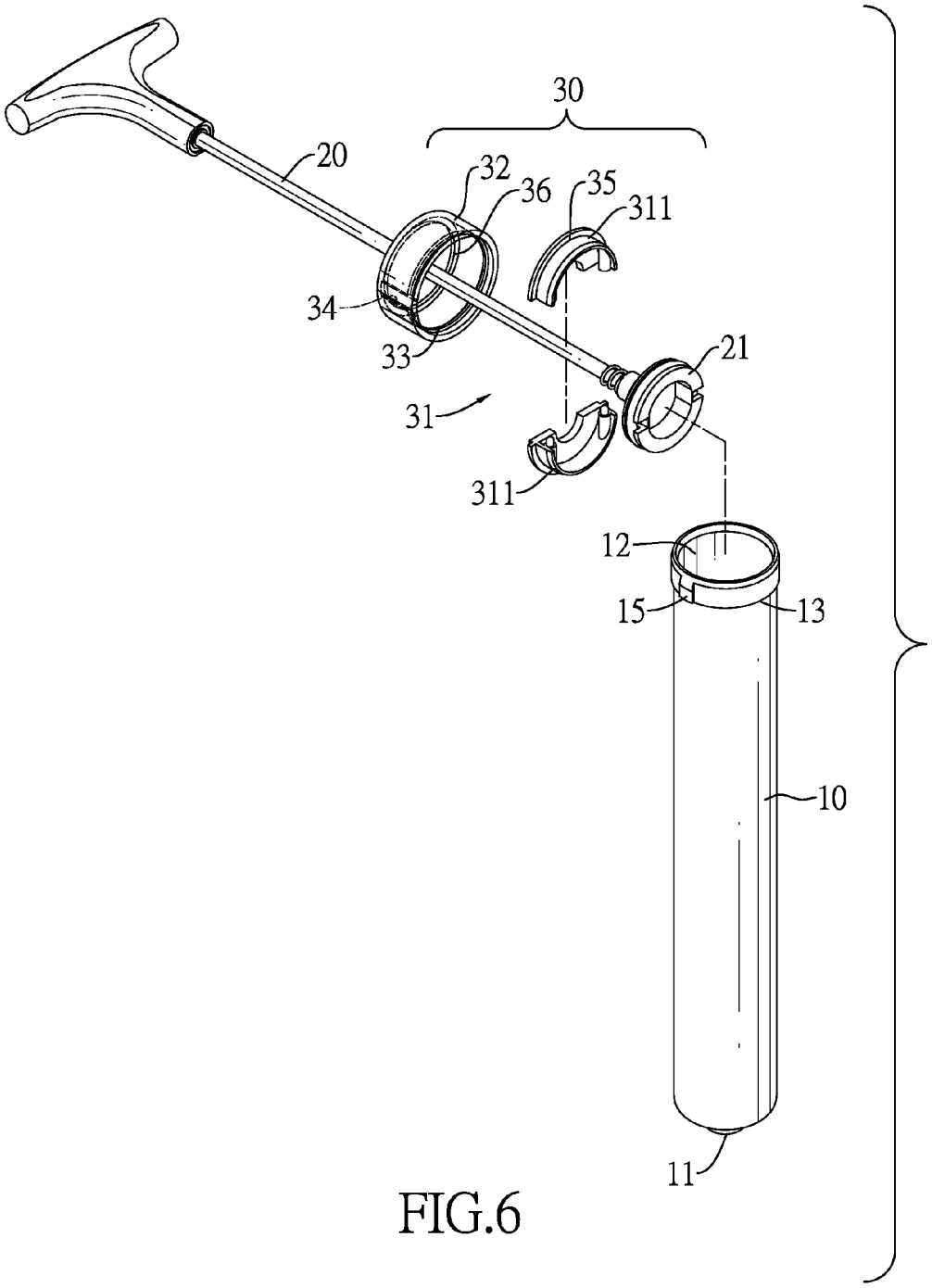
FIG. 6 is an exploded perspective view of a fourth embodiment of an air pump in accordance with the present invention.
Figure 7:
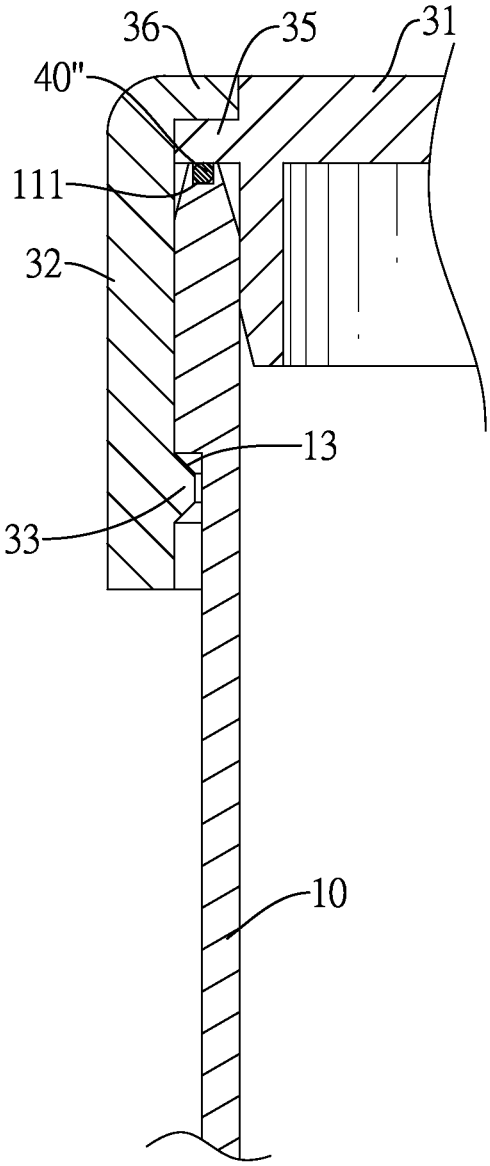
FIG. 7 is an enlarged cross sectional side view of the air pump in FIG. 6.
Figure 8:
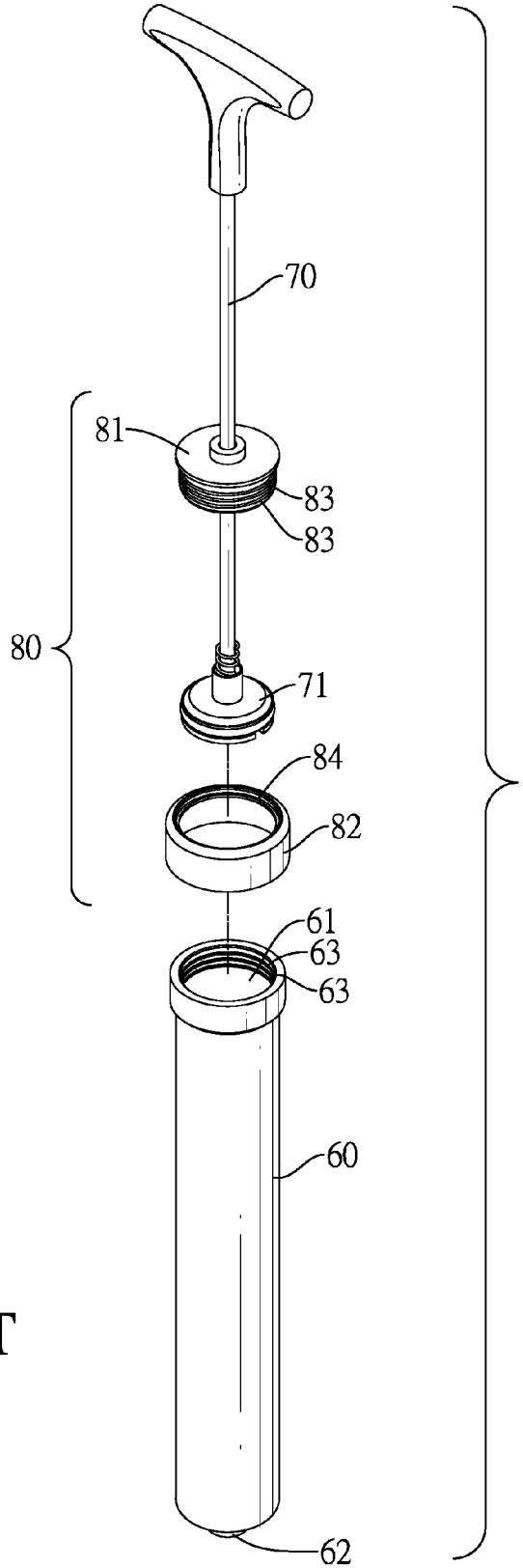
FIG.8 PRIOR ART
FIG. 8 is an exploded perspective view of an air pump in accordance with the prior art.
Figure 9:
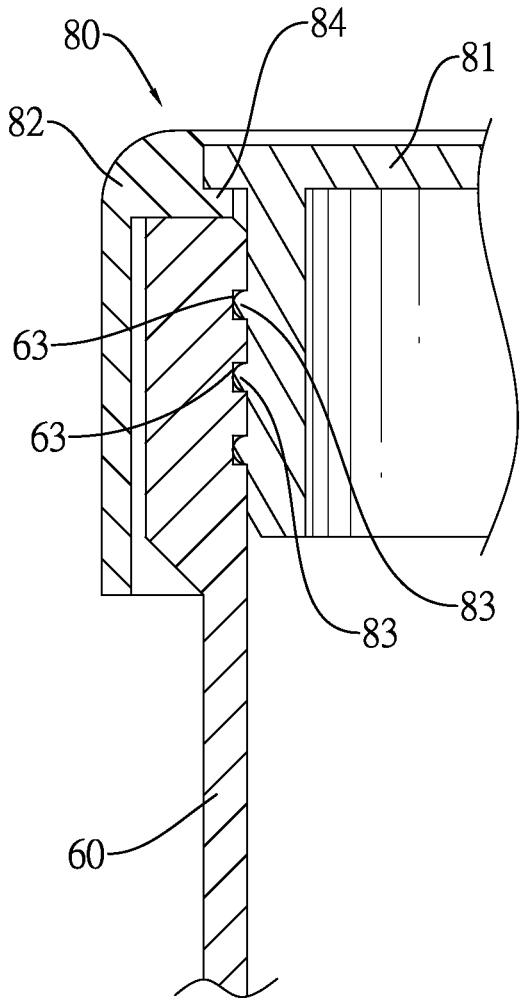
FIG.9 PRIOR ART
FIG. 9 is an enlarged cross sectional side view of the air pump in FIG. 8.

With reference to FIGS. 6 and 7, the top cover 31 has a wing 35, and the wing 35 is radially formed on and protrudes outward from a top end of the top cover 31, and then the wing 35 abuts the top end of the body 10. The sleeve 32 has an abutting flange 36. The abutting flange 36 is radially formed on and protrudes inward from a top end of the sleeve 32, and then the abutting flange 36 abuts against the wing 35 of the top cover 31. When the outer protrusion 13 of the body 10 is pressed into the sleeve 32 of the seal cap assembly 30, the abutting flange 36 of the sleeve 32 abuts against the wing 35 of the top cover 31, and the retaining rib 33 is pressed against the retaining surface of the outer protrusion 13. Accordingly, the sleeve 32 is secured on the top cover 31 on the top end of the body 10. Furthermore, the top cover 31 has two cover elements 311, and the cover elements 311 are combined with each other in symmetry.

Figure 4:
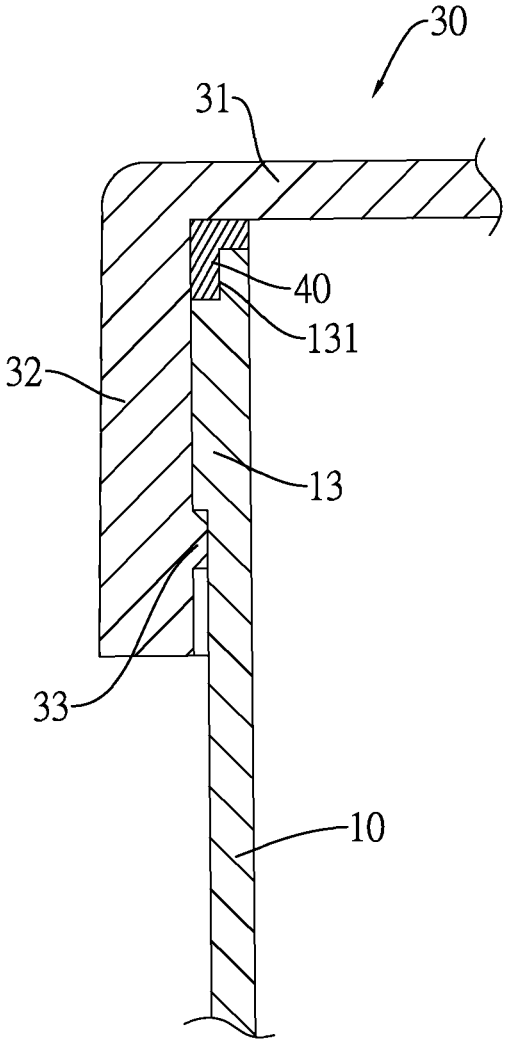
FIG. 4 is an enlarged cross sectional partial side view of the air pump in FIG. 1 combined with a sealing ring having an L-shaped cross section.
Figure 5:
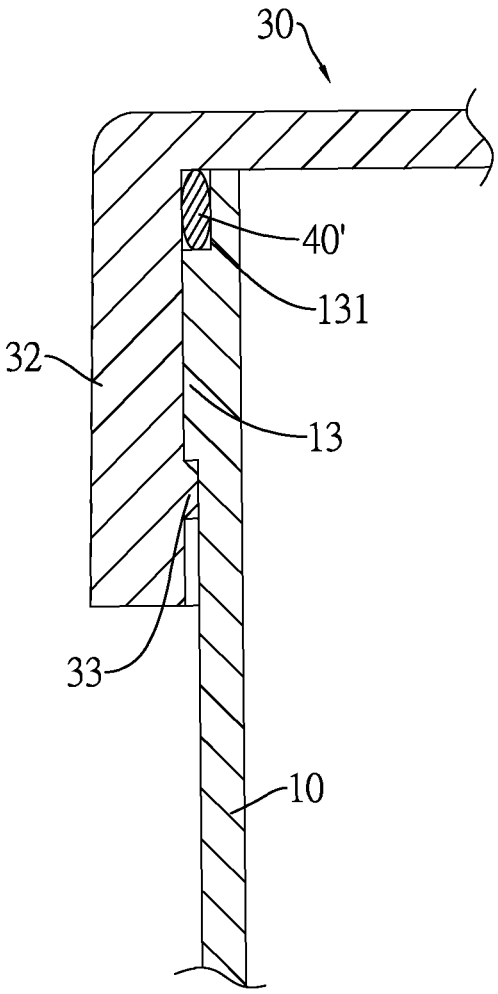
FIG. 5 is an enlarged cross sectional partial side view of the air pump in FIG. 1 combined with a rubber ring.

The air pump is a two-way air pump, and the rotation relationship between the seal cap assembly 30 and the body is prevented. With reference to FIG. 4, the body has a groove 131 and a sealing ring 40 having an L-shaped cross section. The groove 131 is formed around a top end of the outer protrusion 13. The sealing ring 40 is mounted in the groove 131 and abuts against the inner surface of the sleeve 32. With reference to FIG. 5, the body 10 has a groove 131 and a rubber ring 40'. The groove 131 is formed around a top end of the outer protrusion 13. The rubber ring 40' is mounted in the groove 131 and abuts against the inner surface of the sleeve 32. With reference to FIG. 7, the body 10 has a groove 111 and a sealing ring 40". The groove 111 is formed in a top end of the outer protrusion 13. The sealing ring 40" is mounted in the groove 111 and abuts against a bottom surface of the wing 35.

To combine the seal cap assembly 30 with the body 10, the first engaging part 14 of the body 10 is aligned with and pressed into the second engaging part 34 of the seal cap assembly 30. The retaining rib 33 abuts against the retaining surface of the outer protrusion 13 to prevent the seal cap assembly 30 being detached from the body 10. With the engagement between the first engaging part 14 of the body 10 and the second engaging part 34 of the seal cap assembly 30, the relative rotation between the body 30 and the seal cap assembly 30 is prevented.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An air pump comprising:

a body being hollow and having:

an axis defined axially through the body;

a top end;

a bottom end opposite to the top end of the body;

an opening formed in the top end of the body;

a nozzle mounted on the bottom end of the body;

an outer protrusion radially formed on and protruding from an outer surface of the body at the top end of the body, and having an outer surface;

a bottom surface; and a retaining surface formed on the bottom surface of the outer protrusion; and a first engaging part longitudinally mounted on the outer surface of the outer protrusion and being parallel to the axis of the body, and having a first radial section formed on and radially protruding from the outer surface of the outer protrusion, being perpendicular to the axis of the body, being in a rectangular shape, and having two rotating-proof surfaces respectively formed on two opposite sides of the first engaging part, the two rotating-proof surfaces connected to and being perpendicular to the outer surface of the outer protrusion;

a piston rod inserted into the body and having a piston mounted on an end of the piston rod and located in the body; and a seal cap assembly having a top cover movably mounted on the piston rod; and a sleeve mounted on the top end of the body and having an inner surface;

a retaining rib radially protruding from the inner surface of the sleeve and abutted against the retaining surface of the outer protrusion; and a second engaging part longitudinally mounted on the inner surface of the sleeve and being parallel to the axis of the body and engaged with the first engaging part of the body.

2. The air pump as claimed in claim 1, wherein the sleeve of the seal cap assembly is integrally formed with the top cover of the seal cap assembly.

3. The air pump as claimed in claim 2, wherein the body has:

a groove formed around a top end of the outer protrusion; and a sealing ring having an L-shaped cross section and mounted in the groove and abutted against the inner surface of the sleeve.

4. The air pump as claimed in claim 2, wherein the body has:

a groove formed around a top end of the outer protrusion; and a rubber ring mounted in the groove and abutted against the inner surface of the sleeve.

5. The air pump as claimed in claim 1, wherein the top cover has:

a wing radially formed on and protruding outward from a top end of the top cover, and the wing abutting the top end of the body;

the sleeve has:

an abutting flange radially formed on and protruding inward from a top end of the sleeve, and the abutting flange abutted against the wing of the top cover; and wherein the retaining rib of the sleeve is pressed against the retaining surface of the outer protrusion, and the sleeve is secured on the top cover on the top end of the body.

6. The air pump as claimed in claim 5, wherein the top cover has two cover elements, and the cover elements are combined with each other in symmetry.

7. The air pump as claimed in claim 6, wherein the body has:

a groove formed around a top surface of the outer protrusion; and a sealing ring mounted in the groove and abutted against a bottom surface of the wing.

8. The air pump as claimed in claim 1, wherein the body has:

a third engaging part longitudinally mounted on the outer surface of the outer protrusion of the body, being parallel to the axis of the body, and having a second radial section of the third engaging part formed on and protruding radially from the outer surface of the outer protrusion, being perpendicular to the axis of the body, and having a rectangular shape;

the seal cap assembly has:

a fourth engaging part longitudinally mounted on the inner surface of the sleeve, being parallel to the axis of the body, and engaged with the third engaging part of the body.

9. The air pump as claimed in claim 3, wherein the body has:

a third engaging part longitudinally mounted on the outer surface of the outer protrusion of the body, being parallel to the axis of the body, and having a second radial section of the third engaging part formed on and protruding radially from the outer surface of the outer protrusion, being perpendicular to the axis of the body, and having a rectangular shape;

the seal cap assembly has:

a fourth engaging part longitudinally mounted on the inner surface of the sleeve, being parallel to the axis of the body, and engaged with the third engaging part of the body.

10. The air pump as claimed in claim 4, wherein the body has:

a third engaging part longitudinally mounted on the outer surface of the outer protrusion of the body, being parallel to the axis of the body, and having a second radial section of the third engaging part formed on and protruding radially from the outer surface of the outer protrusion, being perpendicular to the axis of the body, and having a rectangular shape;

the seal cap assembly has:

a fourth engaging part longitudinally mounted on the inner surface of the sleeve, being parallel to the axis of the body, and engaged with the third engaging part of the body.

11. The air pump as claimed in claim 7, wherein the body has:

a third engaging part longitudinally mounted on the outer surface of the outer protrusion of the body, being parallel to the axis of the body, and having a second radial section of the third engaging part formed on and protruding radially from the outer surface of the outer protrusion, being perpendicular to the axis of the body, and having a rectangular shape;

the seal cap assembly has:

a fourth engaging part longitudinally mounted on the inner surface of the sleeve, being parallel to the axis of the body, and engaged with the third engaging part of the body.

12. The air pump as claimed in claim 11, wherein the body has:

multiple securing grooves formed in the outer surface of the outer protrusion; and the sleeve has:

multiple securing ribs formed on and protruding from the inner surface of the sleeve, and respectively engaged with the securing grooves of the body.

13. The air pump as claimed in claim 12, wherein the first engaging part and the third engaging part of the body are keys and the second engaging part and the fourth engaging part of the seal cap assembly are keyways.

* * * * *